United States Patent [19]

Haenni et al.

[11] Patent Number: 4,552,002

[45] Date of Patent: Nov. 12, 1985

[54] PLATE BENDING APPARATUS

[75] Inventors: Eduard Haenni; Theo Frei, both of Zofingen, Switzerland

[73] Assignee: Hammerle, AG, Zofingen, Switzerland

[21] Appl. No.: 701,649

[22] Filed: Feb. 14, 1985

Related U.S. Application Data

[63] Continuation of Ser. No. 498,517, May 26, 1983, abandoned.

[30] Foreign Application Priority Data

Jun. 7, 1982 [AT] Austria ..... 2207/82

[51] Int. Cl.[4] ..... B21B 37/08

[52] U.S. Cl. ..... 72/19; 72/389; 72/702

[58] Field of Search ..... 72/387, 7, 19, 21, 20, 72/26, 30, 702, 462

[56] References Cited

U.S. PATENT DOCUMENTS

| | | | |
|---|---|---|---|
| 3,389,432 | 6/1968 | Griesheimer et al. | 73/771 |
| 3,564,883 | 2/1971 | Koors et al. | 72/19 |
| 4,010,679 | 3/1977 | Dybel | 72/26 |
| 4,282,738 | 8/1981 | Kojima | 72/389 |
| 4,322,994 | 4/1982 | Mohr | 72/481 |
| 4,408,471 | 10/1983 | Gossard et al. | 72/21 |

FOREIGN PATENT DOCUMENTS

| | | | |
|---|---|---|---|
| 2715815 | 10/1978 | Fed. Rep. of Germany | 72/389 |
| 138514 | 11/1979 | German Democratic Rep. | 72/26 |
| 7900805 | 10/1979 | Switzerland | 72/389 |
| 2091604 | 8/1982 | United Kingdom | 72/19 |
| 564042 | 7/1977 | U.S.S.R. | 72/389 |

*Primary Examiner*—Daniel C. Crane
*Assistant Examiner*—David B. Jones
*Attorney, Agent, or Firm*—Karl F. Ross; Herbert Dubno

[57] ABSTRACT

An apparatus for bending a plate utilizing a bending punch and a die into which the bending punch penetrates to a greater or lesser extent depending on the bending angle α. The magnitude and variation of the bending force required during deformation of the plate unit are determined and utilized to determine the depth h of punch penetration.

3 Claims, 8 Drawing Figures

PLATE BENDING APPARATUS

This application is a continuation of application Ser. No. 498,517 filed May 26, 1983, now abandoned.

FIELD OF THE INVENTION

The present invention relates to an apparatus for bending plates comprising a bending punch and die into which the bending punch penetrates to a greater or lesser extent depending on the bending angle $\alpha$.

BACKGROUND OF THE INVENTION

In known manner, the bending angle is determined by the vertical position of the edge of the punch with respect to the bearing points in the die. In the case of thin-gauge plates, this position can be precisely determined within a tolerance range of a few hundredths of a millimeter over the entire edge length, since even a deviation of 0.04 mm will result in an error of 1°. This imples a very precise retention of the bottom terminal position of the bending punch and precise compensation for the machine and tool tolerances.

A substantial simplification and improvement were provided by the proposal to establish the position of the punch by a vertical displacement of the die bottom, all of the machine-induced influences on the bending angle thereby being neutralized. The required angle $\alpha$ may then be determined in uncomplicated and repeatable manner by the vertical displacement of the die bottom. The possibility also exists to bend different angles one after another in one operation by a program-controlled or "NC"-controlled displacement of the die bottom. Here, "NC" means Numerical Control, e.g. digital control of the computer program.

It was observed, however, that despite precise setting and persistance of the depth of penetration, e.g. by precise vertical adjustment of the die bottom, bending angle differences intervene during repetition of the bending operation on different qualitatively equivalent plate units. This derives from the fact that the theoretical sharp edge is never formed in the plate during the bending operation, but that this edge is rounded to a greater or a lesser extent. The radius of curvature also effects the bending angle to a quite substantial degree. On the other hand, the curvature varies in the case of two theoretically equivalent plates as a function of manufacture, structure, etc. In other words, two qualitatively equivalent plate units produced by different makers display bending angles differing from each other after processing on the same apparatus and under constant setting of the latter, since the curvatures engendered during bending differ from each other. This is a great disadvantage which could not be eliminated satisfactorily until the present invention provided the means to overcome this problem.

OBJECTS OF THE INVENTION

It is an object of the invention to minimize and to eliminate this disadvantage of apparent different bending angles and to provide a method whereby the depth of penetration of the punch may be established to correspond precisely to the angle which is to be obtained, in such manner that allowance is made for the variable individual plate properties while bending to achieve the desired result.

It has now been observed that the bending angle depends on the magnitude of the forces occurring during the bending operation, at a constant depth of penetration of the bending punch.

A further object is to utilize this observation and determine the magnitude and variation of the bending force required during deformation to thereby determine the depth of penetration which is to be achieved and in this manner more accurately correlate the bending operation to the bending angle $\alpha$ in a reproducible fashion.

SUMMARY OF THE INVENTION

The apparatus of the invention for bending a plate, comprises a bending punch and a die into which the bending punch penetrates to a greater or lesser extent depending on the bending angle, and means whereby the magnitude and variation of the bending force required during deformation of the plate unit are determined and utilized to determine the depth of penetration.

The apparatus thus uses a measuring system for continuous determination of the force acting on the punch during deformation of the plate provided in or on the punch; said measuring system being in communication with a calculating device coupled with a control unit which influences and controls the depth of penetration of the punch. The punch control device which is coupled to the control unit in the system for vertical displacement of the die bottom is thus effectively controlled by said control unit.

BRIEF DESCRIPTION OF THE DRAWING

In order that the invention may be more clearly understood, reference will now be made to the accompanying drawing which shows diagrams in explanation of the method, and one embodiment of the apparatus by way of example in diagrammatic form, and in which.

SPECIFIC DESCRIPTION

Figure 1:
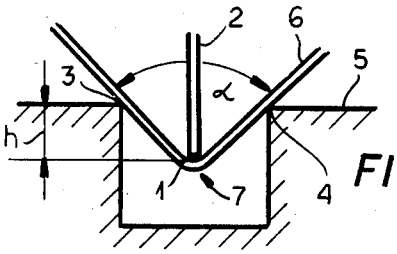
FIG. 1 shows a diagrammatical sketch, partly in section, illustrating the bending angle achieved by penetration of a punch into the die cavity.

Referring now to the drawing, as will be apparent from the diagrammatical sketch of FIG. 1, the bending angle $\alpha$ is determined by the position of the edge 1 of the bending punch 2 with respect to the inlet edges 3 and 4 of the die. This position is established by the depth h of penetration of the punch. During the bending action however, the plate 6 is bent with a radius 7 which differs depending on the plate qualities, even in the case of qualitatively equivalent plates which have been produced by different makers or at different times. It follows that at constant depth h of penetration of the punch 2, the angle $\alpha$ does not remain constant but varies even under utilization of the same die 5 comprising the inlet edges 3 and 4. If the graph of forces is then plotted for three different plates as a function of the punch displacement, the curves designate 10, 11 and 12 in FIG. 2 are obtained for the different but qualitatively equivalent plates, and the curves show the displacement being measured as the depth h of punch penetration while the force required for curve 12 is higher than 10 and the force required for curve 11 is lower than 10.

It is apparent from the graph that the softer plate is that which is represented by curve 11 and requires less force and the harder plate shown in curve 12 requires more force than that required to bend the "normal" during the bending operation and until the depth h of punch penetration is reached. This has the result in practice that by the time the depth h of penetration is reached, the plate 10 for example is bent to precisely 90°, the softer plate 11 being bent a little less, e.g. to 91°, whereas the harder plate 12 is bent to 89°.

Figure 2:
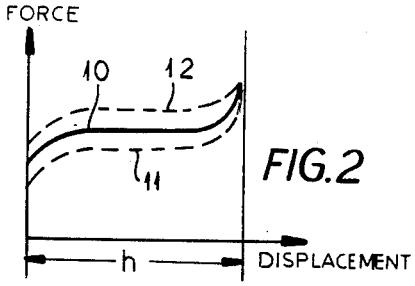
FIG. 2 is a graph of the forces required along the ordinate and the depth of penetration along the abscissa.
Figure 3:
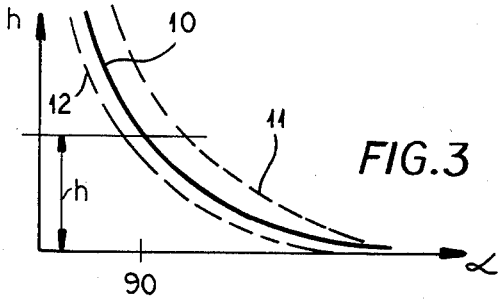
FIG. 3 is another graph depicting the connection between the depth of penetration of the punch plotted along the ordinate and the bending angle plotted along the abscissa which is observed for different plates.
Figure 4:
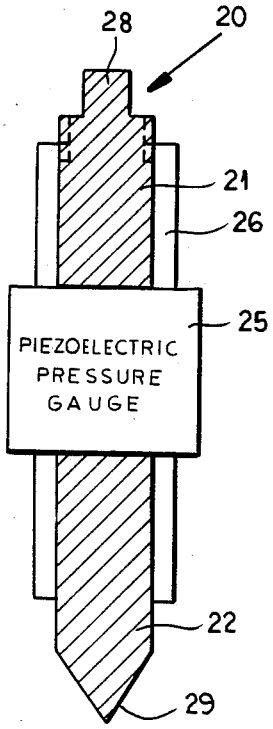
FIG. 4 shows a diagrammatic section of a bending punch of the present invention in a view taken along line IV-IV of FIG. 5.
Figure 5:
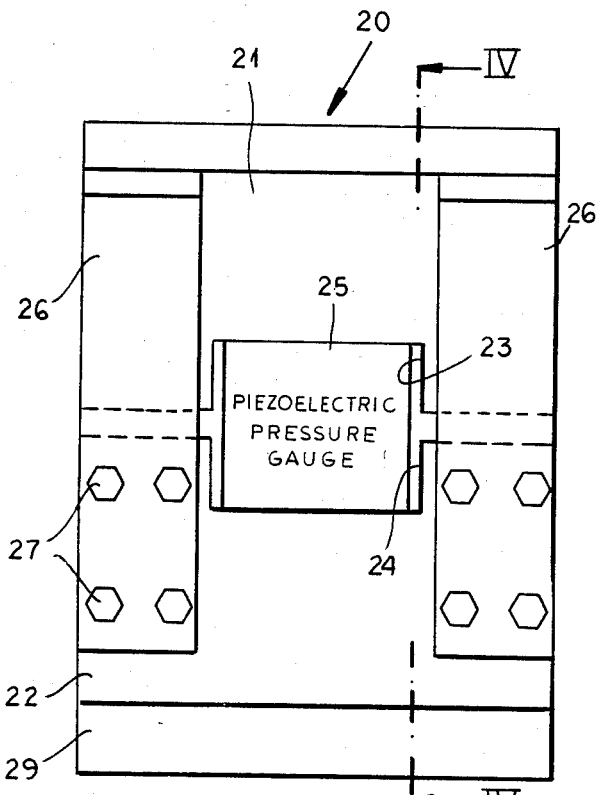
FIG. 5 shows an elevational view of the bending punch in accordance with the invention.
Figure 6:
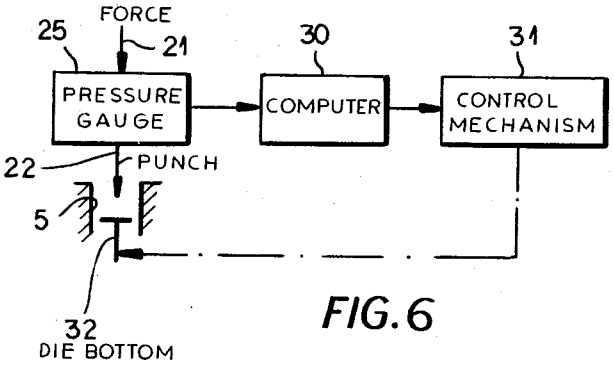
FIG. 6 is a block diagram illustrating principles of the invention.
Figure 8:
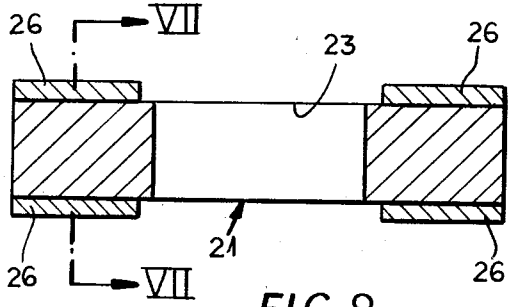
FIG. 8 is a section along line VIII—VIII of FIG. 7.
Figure 7:
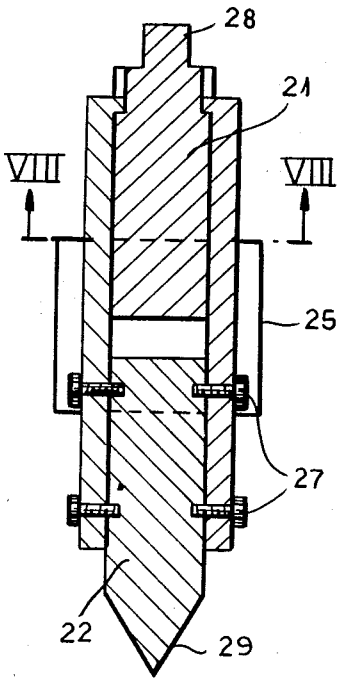
FIG. 7 is a section similar to FIG. 4 but taken through guides thereof and along the line VII—VII of FIG. 8.

These conditions are depicted in the curves shown in the graph in FIG. 3, these curves showing the dependence of the bending angle $\alpha$ on the depth of punch penetration for the different plate represented by the curves 10, 11 and 12 on the graph in FIG. 2.

To obtain the required angle of 90° with all three plates represented by curves 10, 11 and 12, a lesser depth of penetration is sufficient in the case of the plate 12, whereas a greater depth of penetration is required for the plate 11 than for the plate 10. A relationship consequently prevails between the bending angle $\alpha$ and the depth of penetration h which depends on the graph of forces in question. In accordance with the invention, the magnitude and variation of the bending force required are measured in the bending punch and the measured values are supplied to a calculating device or computer connected with the control which individually determines the depth of penetration for the plate in question asnd correspondingly affects the punch feed.

In its application, a plate is bent to precisely the required angle during a test run, and the magnitude and variation of the bending force in the bending punch during the bending operation are stored as a function of the depth of punch penetration. Upon bending another plate, the graph of forces is compared to the stored graph of forces and the differences are utilized for correction of the depth of penetration.

A bending punch 20, in accordance with the invention, is oblong in shape, operates in accordance with the principle of the invention shown in FIG. 1 by penetrating to a predetermined angle $\alpha$ at a specified height h and is illustrated in FIGS. 4–8, and comprises an upper section 21 and a lower section 22. The two sections 21 and 22 each have a cavity 23 and 24, respectively, in their sides turned towards each other, which in combination form a housing for reception of a measuring system 25. The latter may for example be constructed as an electrical pressure gauge using a piezoelectric quartz crystal. Use may also be made of a so-called strain gauge. Guide rails 26 intended for laterally supporting and guiding the upper section 21 are secured at both sides on the lower section 22 of the punch by means of screws 27. The upper section 21 of the punch is gripped at 28 in conventional manner in the punch carrier of a hydraulic press (not shown). The thrust exerted on the upper section 21 of the punch is transmitted in this manner to the lower section 22 comprising a bending edge 29, via the measuring system 25. The measuring system deterines the force exerted momentarily. The measured values are recorded and processed in a computer 30 linked to a control unit 31.

The control unit 31 which is used in combination with the computer 30 will either perform a direct action on the displacement stroke of the punch, or if use is made of a die comprising a displaceable die bottom 32 can act indirectly. In the case shown, where the control unit 31 acts on a displacing mechanism of the die bottom 32, it is necessary to place the die in the position which will provide the required depth of penetration to correspond to the required bending angle and under these circumstances the displaceable mechanism of the die bottom will serve to make allowances for differences in the individual plate quality of softness, medium hardness and hardness corresponding to the examples represented by curves 10, 11 and 12, respectively.

If the bending punch is divided into a plurality of short interconnected elements supported by a hydraulic cushion it is sufficient to fit a single punch element with the said measuring system since the distribution of forces remains uniform along the edge length of the interconnected short elements.

The novel apparatus of the present invention which has been described above constitutes a substantial advance in the art of metal plate bending since plates will now be capable of being processed automatically with great precision and without having to make allowances for individual differences in physical properties of the plates and in structure and without resetting and corrective operations.

What is claimed is:

1. An apparatus for bending a plate, comprising:

a bending press having a die forming a part of bearing points for supporting a plate to be bent, a movable bottom of said die disposed below said bearing points and movable relative thereto to limit the penetration of a bent edge of said plate to establish a predetermined depth of bending and thereby determining a bending angle for said edge of said plate, and a bending punch disposed above said die and including:

an upper section displaceable by a hydraulic press, a lower section directly below said upper section having a bending edge bearing upon said plate between said points, an electrical pressure gauge having a piezoelectric quartz crystal interposed between said sections, and guide means between said sections for laterally supporting and guiding said upper section on said lower section whereby a plate-bending force applied to said plate by said punch is registered by said electrical pressure gauge;

a computer connected to said electrical pressure gauge for comparing bending forces registered by said gauge with predetermined forces required for a specific plate material to attain a predetermined bending angle as said punch penetrates into said die; and a control unit connected to said computer and to said movable bottom for displacing said movable bottom to limit the depth of which said plate is bent by said punch to a value determined by said computer to obtain said predetermined bending angle for said plate and said material.

2. The apparatus defined in claim 1 wherein said upper and said lower sections each have a side turned toward the other of said sections formed with a respective cavity, said cavity forming a housing for said electrical pressure gauge.

3. The apparatus defined in claim 2 wherein said guide means includes a plurality of rails flanking said sections and on opposite sides of said electrical pressure gauge, said guide rails each being fixed on said lower section by means of screws and extending upwardly to laterally support and guide said upper section.

* * * * *